US006079053A

United States Patent [19]

Clover, Jr. et al.

[11] Patent Number: 6,079,053

[45] Date of Patent: Jun. 27, 2000

[54] HELMET FACEMASK ATTACHMENT ASSEMBLY

[76] Inventors: James B. Clover, Jr., 3721 Beachwood Pl., Riverside, Calif. 92506; Charles W. Erichsen, 651 E. Tudor St., Covina, Calif. 91722; Jerome F. Wall, 4444 Magnolia Ave., Riverside, Calif. 92501

[21] Appl. No.: 09/300,250

[22] Filed: Apr. 27, 1999

[51] Int. Cl.[7] ..... A42B 3/18

[52] U.S. Cl. ..... 2/424; 2/9; 24/458

[58] Field of Search ..... 2/9, 10, 422, 424, 2/425; 24/194, 458, 629, 633

[56] References Cited

U.S. PATENT DOCUMENTS

| | | | |
|---|---|---|---|
| 4,271,537 | 6/1981 | Bowlus et al. | 2/424 |
| 4,370,759 | 2/1983 | Zide | 2/424 |
| 4,390,995 | 7/1983 | Walck | 2/9 |
| 4,633,531 | 1/1987 | Nimmons | 2/424 |
| 4,774,729 | 10/1988 | Coates et al. | 2/424 |
| 4,837,866 | 6/1989 | Rector et al. | 2/424 |
| 4,885,807 | 12/1989 | Snow et al. | 2/424 |
| 5,095,552 | 3/1992 | Parkinson | 2/424 |
| 5,293,649 | 3/1994 | Corpus | 2/424 |
| 5,502,843 | 4/1996 | Strickland | 2/424 |
| 5,555,567 | 9/1996 | Corpus | 2/424 |
| 5,675,875 | 10/1997 | Servatius | 24/704.1 |
| 5,799,377 | 9/1998 | Brown | 2/421 |

*Primary Examiner*—Michael A. Neas
*Attorney, Agent, or Firm*—David P. Gordon; David S. Jacobson; Thomas A Gallagher

[57] ABSTRACT

A facemask clip assembly includes a clip member, a movable member within the clip member, a screw, a nut, and a post member. The clip member has a base portion and a flexible arm portion bendable to lie under the base portion. The base portion includes a circular bore sized to permit the screw head to pass therethrough. The movable member, in a 'secure' position obstructs the bore to a first degree such that the head of the screw is not passable therethrough, and in a 'free' position permits passage of the head of the screw through the bore. The arm portion includes an opening which is alignable with the bore of the base portion when the arm portion is bent under the first portion. The screw shaft is extendable through the bore and the opening, and the nut threadably mates with the screw shaft to secure the base and arm portions of the clip member together. In assembling a facemask to a helmet, the clip member, with movable member in the 'secure' position, is bent about a portion of the facemask. The post member is positioned into opening and bore of the clip member. The shaft of the screw is extended through the bore of the post member and coupled to the nut located inside the helmet. The clip can be released by moving the movable member into the 'free' position.

20 Claims, 4 Drawing Sheets

HELMET FACEMASK ATTACHMENT ASSEMBLY

BACKGROUND OF THE INVENTION

1. Field of the Invention

This invention relates broadly to an attachment assembly for coupling a facemask to an athletic helmet used in contact sports, e.g., a football helmet. More particularly, the invention relates to an attachment assembly which can be manipulated to quickly release the facemask from the helmet.

2. State of the Art

Players of contact sports use helmets and other body protective gear. Typically, the helmets include a rigid outer shell positionable about the skull of the player, a relatively impact-absorbent internal cushioning between the shell and skull, and a rigid plastic or metal wire-frame facemask over the face. The outer shell and cushioning are designed to prevent or minimize serious injury to the head and body of the players. Likewise, the facemask is adapted to provide protection to the face while permitting the player good visibility and the ability to vocalize, as required by the play of sport.

Nevertheless, players may become seriously injured, requiring access to the face of the player. For example, it may be necessary to gain access to the airway of an athlete in a medical emergency. However, gaining such access, e.g., to administer cardiopulmonary resuscitation, has long been a problem. If a player is seriously injured, e.g., if the player may have sustained a neck injury, the player's helmet cannot be removed without causing potential damage to the neck. This is because when the player is lying on his back, the shoulder pads lift the player's shoulder between 1.5 and 2.5 inches off the ground. The size and shape of the helmet are adapted to permit the head to substantially lie in an anatomical orientation in conjunction with the shoulder pads. However, removing the helmet would cause hyperextension of the neck, potentially exacerbating the injury. Therefore, the helmet is left on the injured player's head, and the facemask of the helmet is removed to provide access for medical treatment.

As there exist various ways in which the facemask can be attached to a helmet, there exist a number of ways in which to remove the facemask from the helmet, all of which are unsatisfactory. First, some facemasks are attached to helmets with clips which are bolted to the helmet. See, for example, U.S. Pat. No. 4,633,531 to Nimmons and U.S. Pat. No. 4,370,759 to Zide. The clips utilize a bolt through a clip which is secured inside the helmet with a nut. However, the nut cannot be accessed while the helmet is worn, and rotating the bolt (in the direction of removal) causes consequent rotation of the inner nut, failing to disengage the bolt from the clip. One technique available to remove the bolted-on facemask while the helmet is on the athlete is to use a bolt cutter to cut through the wire frame of the facemask. Another technique is to cut the plastic clips which anchor the face mask to the helmet. However, the use of either technique on an injured player is less than ideal. The removal causes severe jostling of the injured player and is certainly undesirable.

Other facemasks are coupled to helmets via clips designed to offer quicker release of the facemask from the helmet. Such clips are disclosed in U.S. Pat. No. 5,675,875 to Servatius, U.S. Pat. No. 5,502,843 to Strickland, U.S. Pat. No. 4,885,807 to Snow, Jr., U.S. Pat. No. 4,774,729 to Coates et al., and U.S. Pat. No. 4,271,537 to Bowlus et al. These clips are designed to release the facemask from the helmet to thereby prevent injury to a player when the player's facemask is forcibly grabbed by another player. However, these clips often fail to provide the secure coupling of the facemask to the helmet required for high contact play. In addition, if it is necessary to quickly remove the facemask without providing the force for which mask is designed to automatically disengage, removal may nonetheless be difficult.

SUMMARY OF THE INVENTION

It is therefore an object of the invention to provide a clip assembly for attaching a facemask to a protective athletic helmet.

It is another object of the invention to provide a clip assembly which securely holds a facemask to the helmet.

It is a further object of the invention to provide a clip assembly which can be quickly and easily manipulated to disengage the facemask, thereby permitting access to the face of an athlete wearing the helmet.

In accord with these objects, which will be discussed in detail below, a facemask attachment clip assembly is provided which includes an elongated plastic clip member, a slidably movable member within or about the clip member, a screw having a head and a shaft, a nut, and preferably a post member. The clip member has a base portion and a flexible arm portion which is bendable to lie under the base portion. The base portion includes a preferably circular bore sized to permit the head of the screw to pass therethrough and is provided with the movable member. The movable member, in a first 'secure' position obstructs the bore to a first degree such that the head of the screw is not passable therethrough, and in a second 'free' position either does not obstruct the bore or obstructs the bore to a lesser degree than in the 'secure' position such that passage of the head of the screw is permitted through the bore. The flexible arm portion includes an opening which is alignable with the bore of the base portion when the flexible arm portion is bent under the base portion. The screw shaft is extendable through the bore of the base portion and the opening of the flexible arm portion of the clip, and the nut has a hollow internally threaded shaft, and a base which is preferably slightly curved toward the shaft. The post member includes a bore and functions as a stabilizer.

In assembling a facemask to a helmet with the clip assembly of the invention, the clip member, with the movable member coupled thereto in the 'secure' position, is bent about a portion of the frame of the facemask. The post member is then positioned through the oblong opening and into a lower portion of the bore of the clip member. The shaft of the screw is then extended through the bore of the post member. The shaft of the nut is passed from the inside of the helmet into a hole in the helmet. The screw is then rotated relative to the nut to secure the clip assembly to the helmet. The clip assembly is securely attached to the helmet once the head of the screw is snugly seated against the movable member. The assembly is repeated for each of several locations about the facemask to securely couple the facemask to the helmet.

When it is necessary to quickly release the facemask from the helmet, for each clip assembly coupling the facemask to the helmet, an elongate tool such as a screwdriver or the blunt tip of a bandage scissors is utilized to force the movable member into the 'free' position, thereby freeing the movable member, and consequently the clip member, from the head of the screw such that the clip member may be removed thereover. As such, the facemask is safely and quickly released from the clip assembly.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
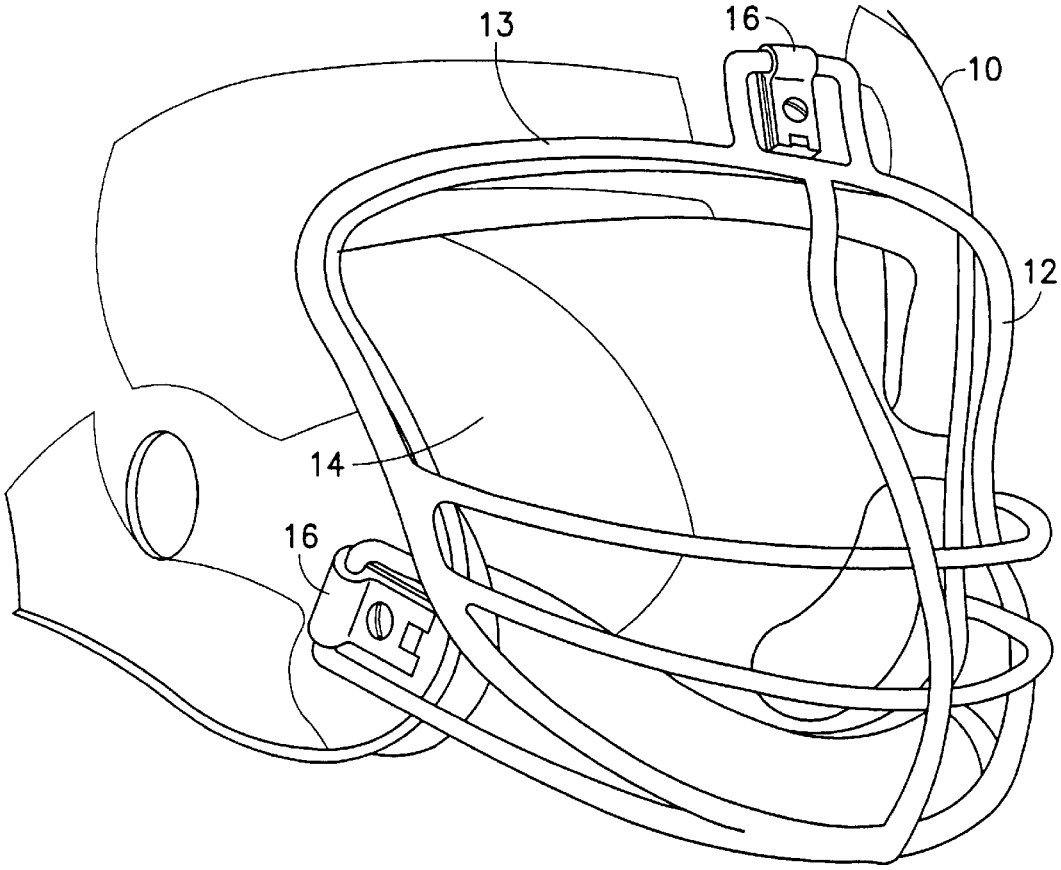
FIG. 1 is a broken perspective view of a helmet provided with a facemask coupled thereto with a clip assembly according to the invention.
Figure 2:
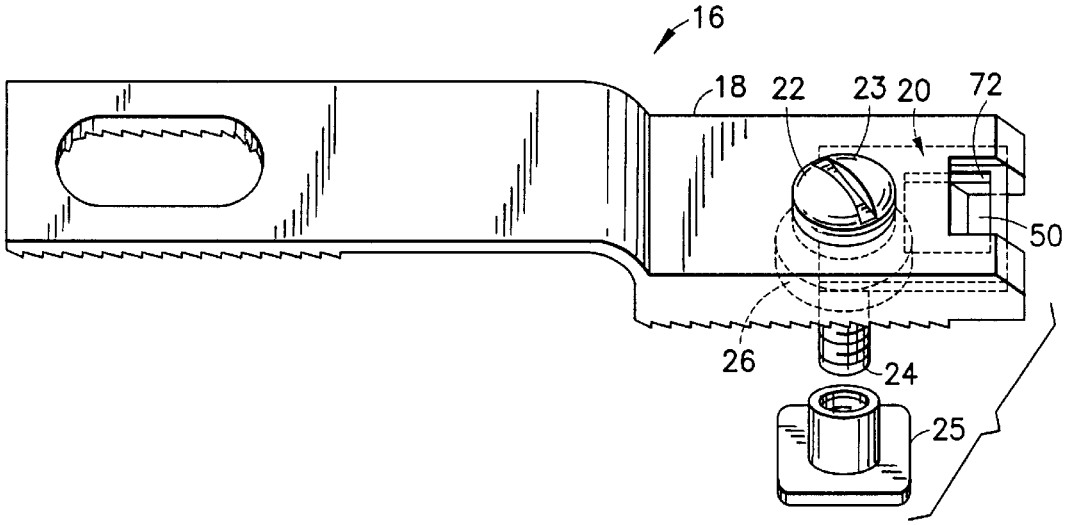
FIG. 2 is a partial transparent unassembled view of the clip assembly according to the invention.

Turning now to FIG. 1, a typical contact sport helmet 10, e.g., a football helmet, is shown. The helmet 10 is provided with a facemask 12 having a frame 13 which is formed about a facial opening 14 of the helmet. The facemask frame 13 is secured to the helmet 10 by a plurality of facemask attachment clip assemblies 16 of the invention. As shown in FIG. 2, the clip assembly 16 generally includes an elongate preferably plastic clip member 18, a latch-type insert 20, a screw 22 having a head 23 and a shaft 24, a nut 25, and preferably a post member 26.

Turning now to FIGS. 3 through 6, the clip member 18 includes a first base portion 30, a second arm portion 32, and a flexible hinge portion 34 coupling the base and arm portions such that the arm portion 32 is bendable about the hinge portion 34 to lie under the base portion 30. The base portion 30 includes a preferably circular bore 36 preferably having a beveled lower circumference 37. The arm portion 32 includes a preferably oblong opening 38. A portion of each undersurface 40, 42 of the base and arm portions 30, 32 is preferably provided with ratchet teeth 44, 46. As described in more detail below, when the arm portion 32 is bent about the hinge portion 34 to lie under the base portion 30, the ratchet teeth 44, 46 permit the two portions 30, 32 to be secured together, with the bore 36 and oblong opening 38 aligned to receive the shaft 24 of the screw 22.

Figure 4:
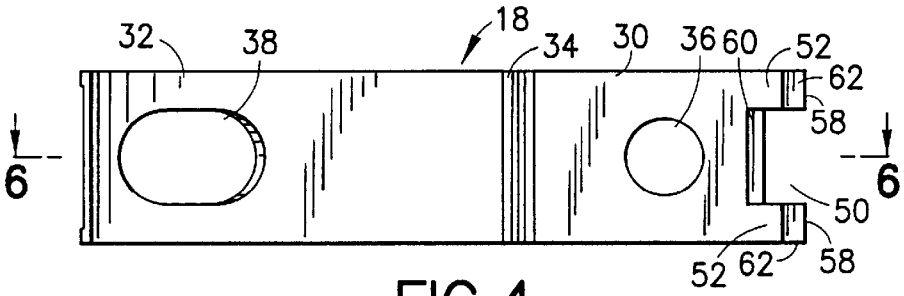
FIG. 4 is a top view of the clip member of the clip assembly according to the invention.
Figure 5:
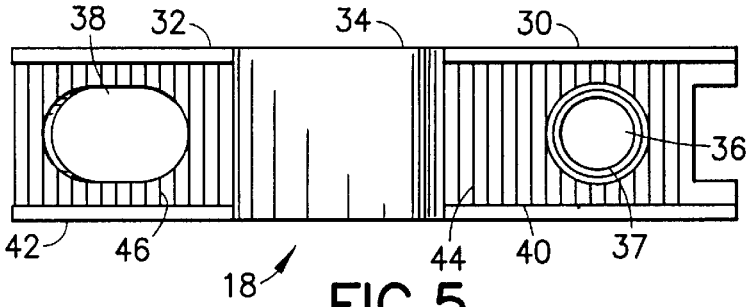
FIG. 5 is a bottom view of the clip member of the clip assembly according to the invention.
Figure 6:
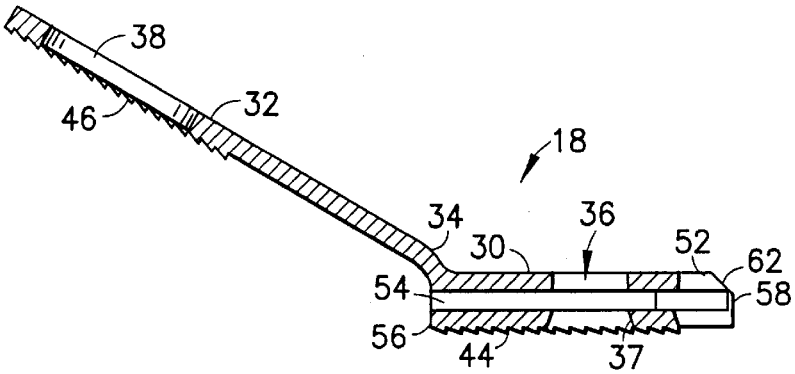
FIG. 6 is a section view across line 6—6 in FIG. 4 of the clip member of the clip assembly according to the invention.
Figure 10:
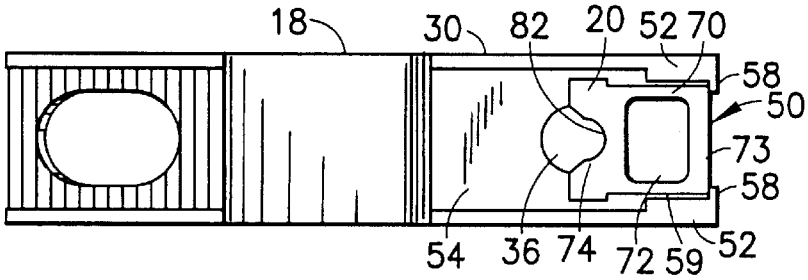
FIG. 10 is a top view of the insert provided in the slot of the clip member, with the base portion of the clip member shown in partial section.

In addition, as shown in FIG. 4, the base portion 30 of the clip member 18 is provided with a front side 48 having a recess 50 defining two arms or extensions 52 extending thereabout. As shown in FIG. 6, the base portion 30 also includes a preferably internal slot 54 extending from a rear side 56 of the base portion 30, into the recess 50 and the two arms 52, and ending at the closed ends 58 of the arms 52. The closed ends 58 of the arms 52 terminate in relatively thin walls, e.g., preferably between 0.01 to 0.0001 inches thick. The thin walls are preferably perforate, crimped, or preslit. The slot 54 is preferably stepped in width, narrowing at 59 through the two arms 52 (FIG. 10). The front side 48 of the first portion 30 at the recess 50 and at the arms 52 preferably includes beveled edges 60 and 62, respectively, which are each preferably angled downward at approximately 450 relative to the upper surface of the first portion.

Figure 7:
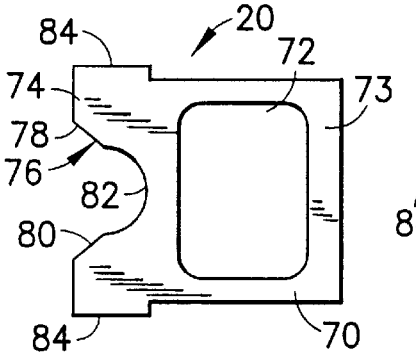
FIG. 7 is a top view of an insert for the clip assembly according to the invention.
Figure 8:
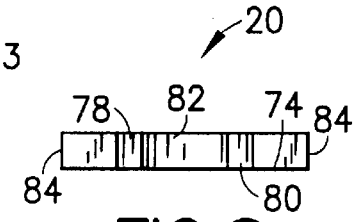
FIG. 8 is a rear view of the insert for the clip assembly according to the invention.
Figure 9:
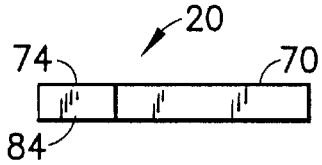
FIG. 9 is a side view of the insert for the clip assembly according to the invention.

Referring now to FIGS. 7 through 9, the latch-type insert 20 is preferably substantially rectangular shaped. The insert 20 includes a tab portion 70 which defines a preferably rectangular opening 72, and includes an end bar 73, and a latch portion 74 preferably provided with a contour 76. The contour 76 preferably defines first, second, and third curves, 78, 80, and 82, respectively. The first and second curves 78, 80 curve along a first radius of curvature which substantially matches the radius of curvature of the bore 36 in the base portion 30 of the clip member 18, and is preferably slightly larger than the radius of curvature of the head 23 of the screw 22. The third curve 82 is provided between the first and second curves 78, 80 and has a second radius of curvature smaller than the radius of curvature of the head 23 of the screw 22. The latch portion 74 of the insert 20 preferably is also provided with lateral wings 84.

Turning now to FIG. 10, the latch-type insert 20 is positioned within the slot 54 of the base portion 30 of the clip member 18 such that the bar 73 of the tab portion 70 of the insert 20 extends between the arms 52 of the base portion 30 of the clip member 18, across the recess 50, and abuts the closed ends 58 of the arms 52. As such, the opening 72 in the insert 20 overlies the recess 50 of the base portion 30 of the clip member 18. In addition, in this position, referred to hereinafter as the 'secure' position, the contour 76 of the latch portion 74 of the insert 20 overlies the bore 36 of the base portion 30 of the clip member 18 such that the third curve 82 defines part of a circular pathway substantially concentric with the bore 36, and the latch portion 74 surrounding the third curve functions as seat for the screw head 23.

Figure 11:
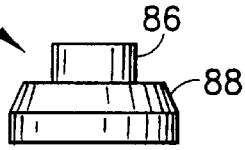
FIG. 11 is a side view of a post member of the clip assembly according to the invention.
Figure 12:
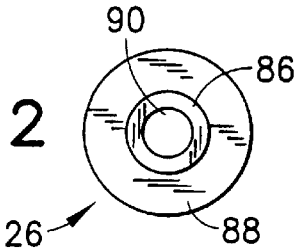
FIG. 12 is a top view of the post member of the clip assembly according to the invention.

Referring now to FIGS. 11 and 12, the post member 26 includes a generally toroidal portion having a beveled upper circumference 88 and an upper cylindrical portion 86. The upper cylindrical portion 86 preferably substantially matches the radius of curvature of the third curve 82 of the contour 76 of the insert 20 (FIG. 7). The post member 26 defines an axial bore 90 having a diameter capable of receiving the shaft 24 of the screw 22.

Figure 13:
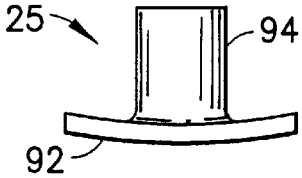
FIG. 13 is a side view of a nut member of the clip assembly according to the invention.
Figure 14:
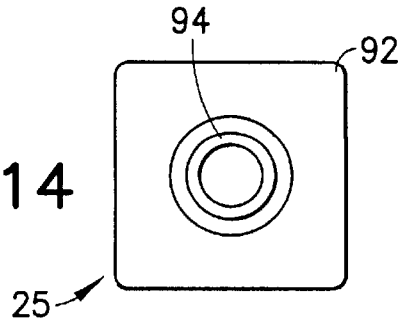
FIG. 14 is a top view of the nut member of the clip assembly according to the invention.

Turning now to FIGS. 13 and 14, the nut 25 includes an elongate hollow shaft 94 internally threaded to mate with the shaft 24 of the screw 22, and a base 92 which is preferably slightly curved towards the shaft.

Figure 15:
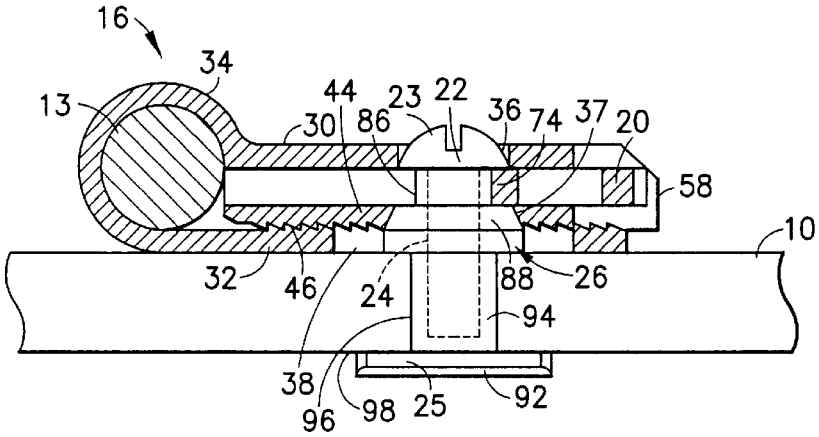
FIG. 15 is a partial section side view of the clip assembly according to the invention shown securing a facemask to a helmet.
Figure 3:
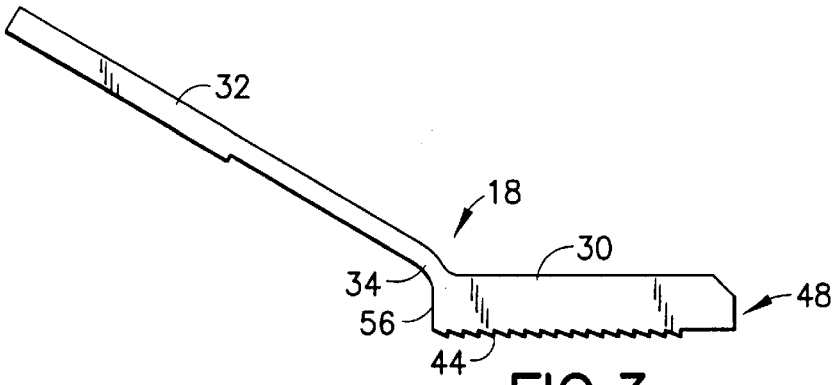
FIG. 3 is a side view of a clip member of the clip assembly according to the invention.

Referring now to FIG. 15, in assembling a facemask to a helmet with the clip assembly 16 of the invention, the clip member 18, with latch-type insert 20 provided therein and positioned in the 'secure' position, is bent at the hinge portion 34 about a portion of the frame 13 of the facemask. The ratchet teeth 46 on the arm portion 32 of the clip member 18 are engaged against the ratchet teeth 44 of the base portion 30 of the clip member 18 such that the clip member 18 snugly surrounds the portion of the frame 13. The oblong opening 38 permits the arm portion 32 to be positioned against various locations of the base portion 30, thereby accommodating various frame diameters permitting the opening 38 to overlie the bore 36. The post member 26 is then positioned into the clip member 18 such that the cylindrical portion 94 extends within the third curved portion 82 of the contour 76 of the insert 20, and also such that the beveled upper circumference 88 of the post member 26 seats within the beveled lower circumference 37 of the circular bore 36 of the clip member 18. The shaft 24 of the screw 22 is then extended through the bore 90 of the post member 26. The shaft 94 of the nut 25 is passed from the inside of the helmet 10 into a hole 96 in the helmet. The screw 22 is then rotated relative to the nut 25 to secure the clip assembly the helmet 10. The clip assembly 16 is securely attached to the helmet 10 once the head 23 of the screw 22 is seated against the latch portion 74 of the insert 20 (surrounding the third curve 82), and when the curved base 92 of the nut 25 is flattened against the interior surface 98 of the helmet. The assembly is repeated for each of several location about the facemask to securely couple the facemask to the helmet.

Referring to FIGS. 2, 10, and 15, when it is necessary to quickly release the facemask from the helmet, for a first clip assembly 16, an elongate tool such as a screwdriver or the blunt tip of a bandage scissors is inserted into the recess 50 of the tab portion 30 of the clip member 18 and through the opening 72 of the insert 20. The beveled edge 60 of the recess 50 facilitates the insertion. The tool is then used to force the insert 20 within the slot 54 of the base portion of the clip member 18 against the thin closed ends 58 of the arms 52 until the closed ends 58 break or spread apart and permit the insert to slidably extend through the closed ends and move within the slot. The insert 20 is moved until the first and second curved portions 78, 80 of the contoured latch portion 74 of the insert 20 lie concentric with the circumference of the bore 36 (a 'free' or 'unlatched' position) thereby freeing the clip member 18 from the head 23 of the screw 22 such that the clip member may be removed thereover. The insert 20 is stopped from completely exiting the slot 54 by contact of the wings 84 against the narrowed portion 59 of the stepped slot, thereby preventing the insert from entering the mouth, nose, or eyes of an injured player wearing the helmet. The process is then repeated for the other clip assemblies 16. As such, the frame 13 of the facemask 12 and the clip members 18 are safely and quickly released from the helmet 10.

There have been described and illustrated herein a facemask attachment clip assembly for a helmet. While a particular embodiment of the invention has been described, it is not intended that the invention be limited thereto, as it is intended that the invention be as broad in scope as the art will allow and that the specification be read likewise. Thus, while a particular movable insert has been disclosed, it will be appreciated that other movable components may be used as well. Furthermore, the movable component may reside over or under the clip member, rather than positioned in a slot therein. In addition, the hinge portion is not necessarily needed, as either one or both of the arm and base portions may be flexible. Also, while particular preferred dimensions for the closed ends of the arms are disclosed, it will be recognized that other dimensions permitting the forcible breaking thereof may be used. Moreover, while the device has been disclosed as being made from plastic, other materials, e.g., metal, may also be used. It will therefore be appreciated by those skilled in the art that yet other modifications could be made to the provided invention without deviating from its spirit and scope as so claimed.

What is claimed is:

1. A clip assembly for coupling a frame of a facemask to a helmet, the helmet having an exterior and an interior, said clip assembly comprising:

a) a clip member having a base portion provided with a bore, a flexible arm portion provided with an opening, said flexible arm portion being bendable about the frame such that said bore of said base portion and said opening of said arm portion overlie each other;

b) a screw having a head diametrically sized to pass through said bore and said opening, and a shaft;

c) a nut at least partly positionable against the interior of the helmet and threadable with said shaft of said screw; and d) a movable member coupled to but movable relative to said base portion of said clip member such that said movable member is movable from a first position in which said movable member partly obstructs said bore such that said head of said screw cannot pass through said bore, to a second position in which said movable member permits said head of said screw to pass through said bore.

2. A clip assembly according to claim 1, wherein:

said base portion of said clip member is provided with a slot, and said movable member is slidably movable within said slot.

3. A clip assembly according to claim 2, wherein:

said base portion of said clip member is provided with a recess defining two arms wherein said slot opens into said recess and extends into said two arms.

4. A clip assembly according to claim 3, wherein:

each of said two arms terminates in a closed end, wherein said movable member must be forced to extend through said closed ends in order to position said movable member in said second position.

5. A clip assembly according to claim 4, wherein:

said closed ends have a wall thickness between 0.01 to 0.0001 inches.

6. A clip assembly according to claim 3, wherein:

said slot is stepped in width having a narrower portion between said two arms.

7. A clip assembly according to claim 3, wherein:

said base portion includes a side bordering said recess which is beveled.

8. A clip assembly according to claim 1, wherein:

said opening in said flexible arm portion of said clip member is oblong.

9. A clip assembly according to claim 1, further comprising:

e) a post member having a toroidal body, a shaft, and a post bore extending therethrough, said post member sized to be received through said opening of said flexible arm portion of said clip member and partially received in said base portion of said clip member.

10. A clip assembly according to claim 9, wherein:

said bore of said base portion of said clip member includes a lower circumference which faces said opening of said flexible arm portion of said clip member when said clip member is bent about the frame, said lower circumference being provided with a beveled edge, and further wherein said body of said post member includes a circumferential beveled edge which mates with said beveled edge of said lower circumference of said bore of said base portion of said clip member.

11. A clip assembly according to claim 1, wherein:

said base and flexible arm portions of said clip member each include ratchet teeth that engage each other when said flexible arm portion is bent about the frame.

12. A clip assembly for coupling a frame of a facemask to a helmet, the helmet having an exterior and an interior, said clip assembly comprising:

a) a clip member having a base portion provided with a bore and a slot, and a flexible arm portion provided with an opening, said flexible arm portion being bendable about the frame of the facemask such that said bore of said base portion and said opening of said flexible arm portion overlie each other;

b) a screw having a head diametrically sized to pass through said bore and said opening, and a shaft;

c) a nut at least partly positionable against the interior of the helmet and threadable with said shaft of said screw; and d) an insert slidable within said slot of said base portion of said clip member such that said insert is slidable from a first position in which a portion of said insert partly obstructs said bore such that said head of said screw cannot pass through said bore to a second position in which said portion of said insert is at least partially removed from said bore such that said head of said screw is permitted to pass through said bore.

13. A clip assembly according to claim 12, wherein:

said portion of said insert is contoured to define first, second and third contours, said first and second contours being curved along a first radius of curvature, and said third contour being curved along a second radius of curvature smaller than said first radius of curvature, said third contour being provided between said first and second contours.

14. A clip assembly according to claim 13, wherein:

said first radius of curvature is substantially the same as a radius of curvature of said bore of said base portion of said clip member.

15. A clip assembly according to claim 13, wherein:

said second radius of curvature is substantially the same as a radius of curvature of said shaft of said screw.

16. A clip assembly according to claim 12, further comprising:

e) a post member having a toroidal body, a shaft, and a post bore extending therethrough, said post member sized to be received through said opening of said flexible arm portion of said clip member and partially received in said bore of said base portion of said clip member.

17. A football helmet having a quickly releasable facemask, comprising:

a) a helmet having a face opening, exterior and interior surfaces, an a plurality of bores;

b) a facemask frame positionable about said face opening; and c) a plurality of attachment assemblies securing said facemask frame to said helmet, each of said attachment assemblies including, i) a clip member having a base portion provided with a screw bore, a flexible arm portion provided with an opening, said flexible arm portion being bent about said frame such that said screw bore of said base portion and said opening of said flexible arm portion overlie each other, ii) a screw having a head diametrically sized to pass through said screw bore and said opening of said flexible arm portion of said clip member, and a shaft extending through said screw bore of said base portion of said clip member and said opening of said flexible arm portion of said clip member, iii) a movable member coupled to and movable relative to said base portion of said clip member such that said movable member is movable from a first position in which said movable member partly obstructs said screw bore such that said head of said screw cannot pass through said screw bore to a second position in which said movable member permits said head of said screw to pass through said screw bore, and iv) a nut having a head and shaft, said head of said nut being positioned against said interior surface of said helmet and said shaft of said nut extending through one of said bores of said helmet and being threadably coupled to said shaft of said screw, wherein when said movable member is in said first position said head of said screw is secured against said movable member, and when said movable member is moved into said second position said head of said screw is passable through said screw bore and said clip member is released from said helmet.

18. A helmet according to claim 17, wherein:

said base portion of said clip member is provided with a slot and a recess defining two arms, each of said two arms terminating in a closed end, said slot opening into said recess and extending into said two arms, wherein said movable member is slidably movable within said slot and said movable member must be forced to break through said closed ends in order to position said movable member in said second position.

19. A helmet according to claim 17, wherein:

said opening in said flexible arm portion of said clip member is elongated.

20. A helmet according to claim 17, wherein:

said attachment assembly further includes a post member having a toroidal body, a shaft, and a post bore extending therethrough, said post member sized to be received through said opening of said flexible arm portion of said clip member and partially received in said screw bore of said base portion of said clip member and said post bore being sized to receive said shaft of said screw therethrough.

* * * * *